United States Patent [19]

Schellenberg

[11] Patent Number: 5,025,981

[45] Date of Patent: Jun. 25, 1991

[54] PACKING CONTAINER

[75] Inventor: Walter Schellenberg, Diepoldsau, Switzerland

[73] Assignee: Rundpack AG, Diepoldsau, Switzerland

[21] Appl. No.: 543,676

[22] Filed: Jun. 25, 1990

[30] Foreign Application Priority Data

Jul. 14, 1989 [CH] Switzerland ..... 02654/89

[51] Int. Cl.[5] ..... B65D 5/42

[52] U.S. Cl. ..... 229/118; 206/459; 229/1.5 B

[58] Field of Search ..... 229/1.5 B, 87.05, 5.5, 229/5.8, 118; 206/611, 622, 630, 459

[56] References Cited

U.S. PATENT DOCUMENTS

| | | | |
|---|---|---|---|
| 1,672,884 | 6/1928 | Gingras | 229/87.05 |
| 2,027,791 | 1/1936 | Schrager | 229/87.05 |
| 2,105,367 | 1/1938 | Parsons | 206/459 |
| 2,108,418 | 2/1938 | Thomas | 229/87.05 |
| 2,150,207 | 3/1939 | Currie | 206/628 |
| 2,330,878 | 10/1943 | Foley | 229/5.5 |
| 3,101,885 | 8/1963 | Walsh | 206/630 |
| 4,550,854 | 11/1985 | Schellenberg | 229/1.5 B |

*Primary Examiner*—Gary E. Elkins

*Attorney, Agent, or Firm*—Ladas & Parry

[57] ABSTRACT

For separate waste utilization of the plastic and cardboard parts of a used packing container (1), the cardboard sleeve (5) reinforcing its circumferential wall (2) and only positively connected thereto has a desired separation strip (10), whose operation leads to the separation thereof. The desired separation strip (10) is formed on the overlap area of the cardboard sleeve (5). It only has one weakening line (16) bounding it on one side and concealed by the overlap. On tearing, the inner overlap edge (13) acts as a cutting edge for the outer overlap layer.

9 Claims, 2 Drawing Sheets

PACKING CONTAINER

The invention relates to a plastic packing container with a cardboard sleeve reinforcing the circumferential wall thereof and shaped from a cardboard blank with an overlap seam, the cardboard sleeve being positively closely held on the plastic container part.

A packing container of the aforementioned type is known from U.S. Pat. No. 4,550,854. In this known packing container, without the use of additional adhesive, the cardboard sleeve is so firmly fitted by positive enclosure in the circumferential walll that it cannot be detached without destroying the container.

The problem of the invention is to enable the material of such containers to be suitable for waste utilization after use. According to the invention this problem is solved in that through a predetermined or desired separation strip provided with a gripping tab and running from the container edge in the direction of the container bottom enabling the cardboard sleeve to be separated from the plastic container part.

Figure 1:
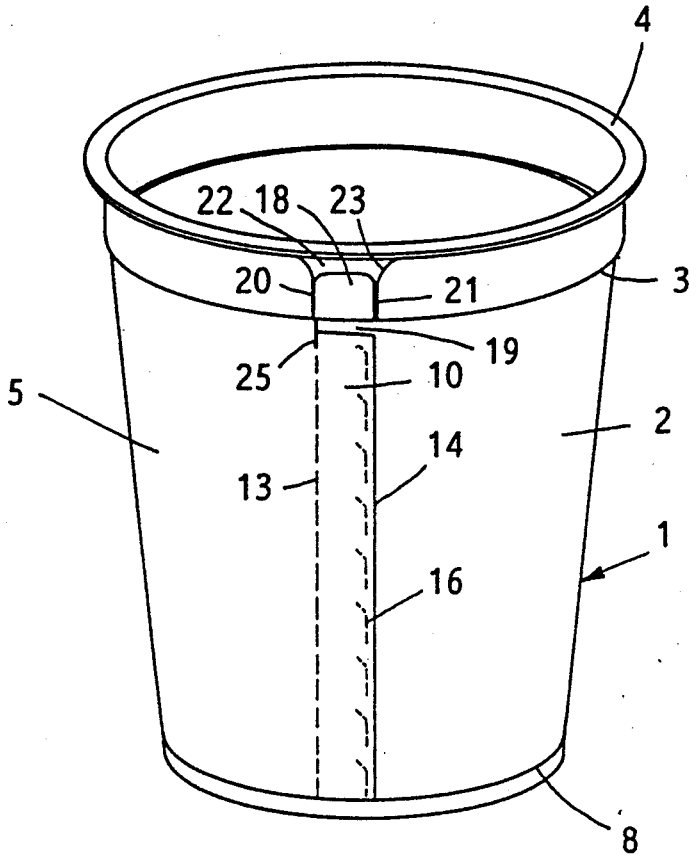

Advantageous embodiments of such a packing container form the subject matter of the dependent claims and can be gathered from the following description of a preferred embodiment relative to the drawings, wherein show:

FIG. 1 a perspective view of the packing container.

Figure 2:
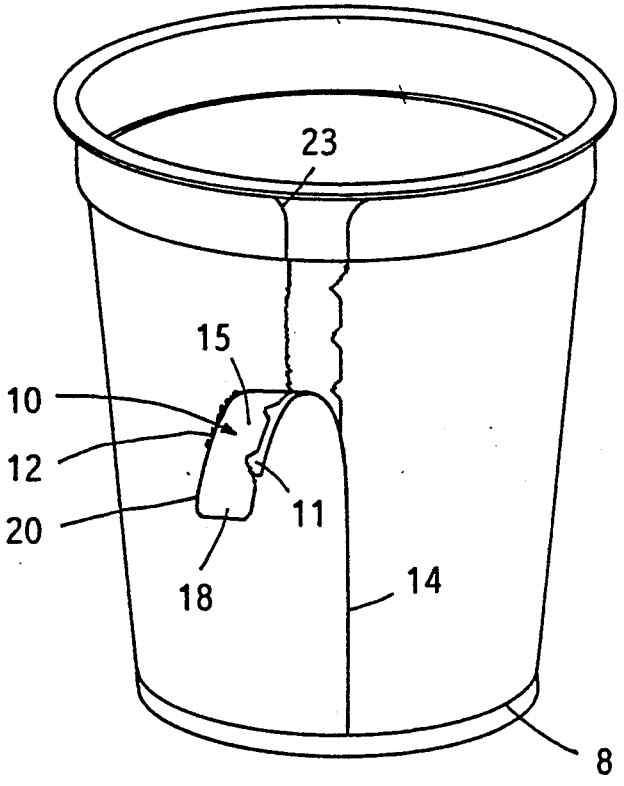

FIG. 2 a view corresponding to FIG. 1 following the partial separation of the desired separation strip.

Figure 3:
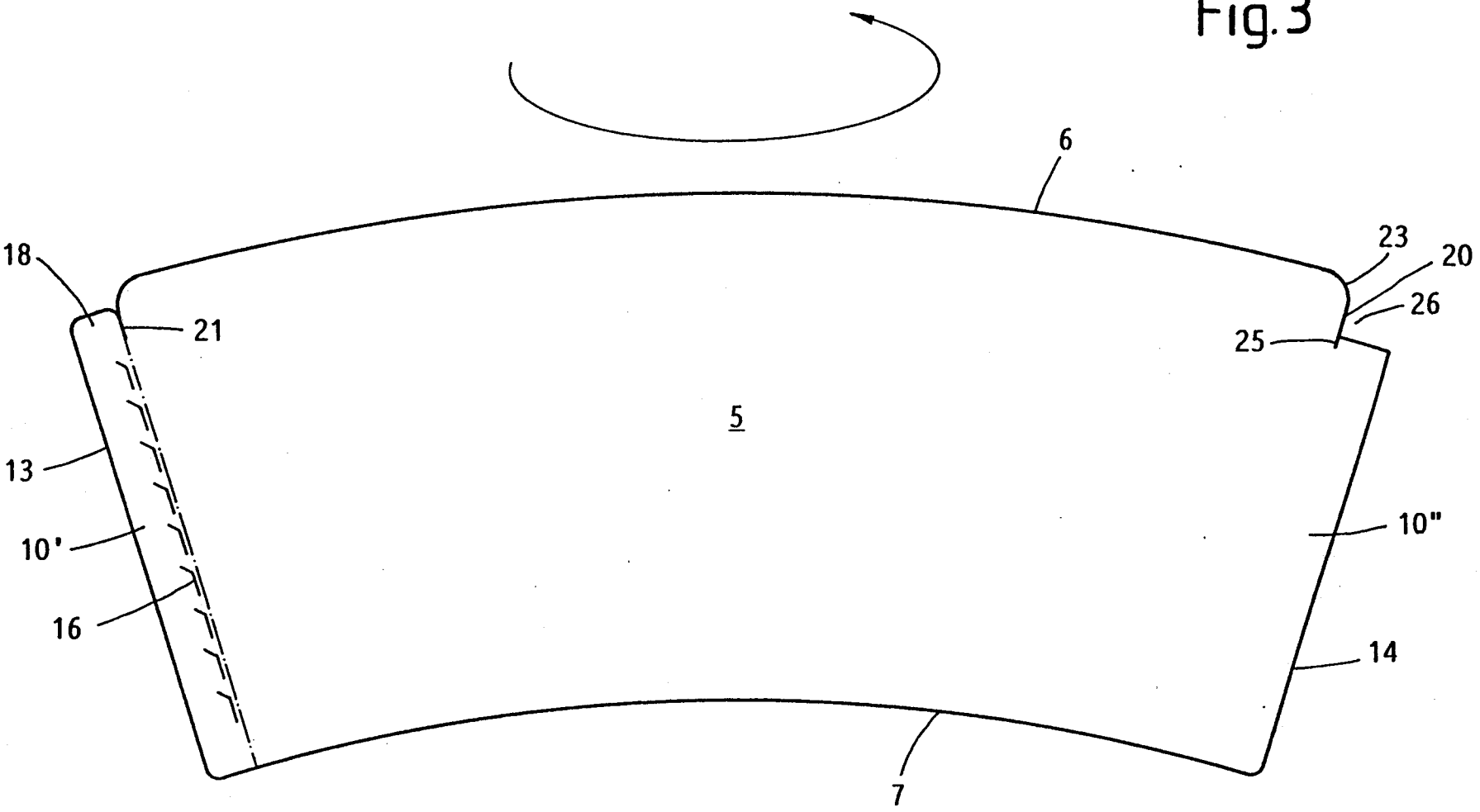

FIG. 3 the spread-out cardboard blank for the production of cardboard sleeve.

The general shape of the packing container of the represented embodiment is known perse. The packing container 1 which is e.g. suitable for dairy products, such as yoghurt and the like has a conical circumferential wall 2, with an all-round step 3 serving as a support shoulder during stacking and with an outwardly projecting marginal flange 4 for fixing an not shown sealing diaphragm.

In order to economize on plastics material the circumferential wall 2 is reinforced by a cardboard sleeve 5, which e.g. has an outer and an inner paper layer so as to permit printing and enclosing between them a layer of lower-quality cardboard material, so-called screenings. The upper edge 6 of the cardboard sleeve 5 engages on the underside of the marginal flange 4, whilst its lower edge 7 is closely supported by a lower step 8, whose width corresponds to the cardboard material thickness. As a result of the close union between the cardboard sleeve 5 and the plastics material of the circumferential wall, such as results from shaping in a deep-drawing mould, there is a significant reinforcement of the container wall.

To enable the separation of the cardboard sleeve 5 from the plastic part of the packing container so as to permit the waste utilization of the latter and so that it can be simply supplied for waste paper purposes, on the circumferential wall 2 is provided a desired separation strip 10 with a gripping tab 18, which enables the complete separation of the cardboard sleeve 5 and consequently the easier removal thereof, because there is no adhesive bond between the plastic container and the cardboard sleeve.

Over most of its length, the predetermined separation strip 10 is in two-layer form, being formed by the superimposition of the inner and outer overlap area 10', 10'' of the cardboard sleeve 5, at which are interconnected by bonding the ends of the cardboard blank according to FIG. 3 following the annular bending together thereof to form a frustum-shaped sleeve. The outer layer 11 of the desired separation strip 10 is on the one hand by a not visible desired or predetermined separating line, which is located over the inner overlap edge 13 and on the other hand by the outer overlap edge 14. The inner layer 15 of the predetermined separation strip 10 is defined on the one hand by the inner overlap edge 13 and on the other hand by a perforation line 16. The perforation line 16 comprises angular incisions arranged in rows. In order to weaken the cardboard sleeve 5 at perforation line 16 with respect to forces acting radially on the packing container, it is covered by the outer overlap area 10'' so that the overlap edge 14 thereof is at an adequate distance from the perforation line 16.

The gripping tab 18 of the predetermined separation strip 10 is formed by an uncovered continuation of the inner layer 15 and has as the lateral boundary on the one hand a continuation 20 of the inner overlap edge 13 and on the other hand an incision 21, which is parallel thereto and which according to FIG. 1 runs in the same line with the outer overlap edge 14. In order to permit the easy raising and gripping of the gripping tab 18 normally engaging on the circumferential wall 2, it is positioned in spaced manner below the marginal flange by a gap 22 provided in the cardboard sleeve 5. This gap can be wider than the predetermined separation strip 10, or can be widened outwards by means of rounded portions 23, so that the gripping tab 18 is clearly visible for use at said gap 22.

For separating the cardboard sleeve 5 from the otherwise plastic packing container 1, the gripping tab 18 is drawn radially outwards, so that the predetermined separation strip 10 is separated from the cardboard sleeve 5 along perforation line 16 and the inner overlap edge 13. This inner overlap edge 13 acts in knife-like manner on the cardboard layer above it, so that there is no need to provide a weakening line thereon. It has been found that on defining the desired separation strip 10 by two perforation lines 16, it is easier to transversely tear the same on using a preferably lower-grade cardboard material for producing cardboard sleeve 5.

In order to facilitate tearing along the not previously weakened and therefore not visible desired separation line by means of the inner overlap edge 13 continuing in gripping tab 18, at the appropriate point in the cardboard sleeve 5 is provided a short starting incision 25, which can be provided as an extension of the boundary edge of said gap 22.

I claim:

1. A packing container comprising:

a plastic container having a top rim, a circumferential wall, and a bottom portion; and a cardboard sleeve surrounding said circumferential wall of said plastic container, said sleeve being formed from a cardboard blank having an upper edge, a lower edge, and inner and outer overlapping edges, said sleeve having a predetermined separation strip and a gripping tab, said predetermined separation strip being formed by said inner and outer overlapping edges being spaced apart to define an overlap area having an inner overlap area and an outer overlap area, said inner overlap area having a weakening line positioned laterally of said inner overlapping edge, said strip at least partially spanning said upper edge and said lower edge of said sleeve, said gripping tab being located at the upper edge of said strip, whereby said sleeve is separated from said plastic container by pulling down on said gripping tab and tearing said separation strip away from said sleeve.

2. The packing container according to claim 1, wherein said weakening line is covered by said outer overlap area, such that said inner overlap area said predetermined separation strip is narrower than said outer overlap area.

3. The packing container according to claim 1, wherein said circumferential wall has in the vicinity of said top rim, a circumferential step, said outer overlap area being set back from said top rim, said step defining an angular cutout of said cardboard blank, wherein said gripping tab is formed by the portion of said inner overlap exposed by said angular cutout.

4. The packing container according to claim 3, wherein said top rim of said plastic container has an outwardly projecting flange, and said upper edge of said sleeve is directly adjacent to said flange except in the vicinity of said gripping tab, said gripping tab being bounded circumferentially on one side by said inner overlap edge and on the other side by an incision on said cardboard sleeve running parallel to said inner overlap edge.

5. The packing container according to claim 4, wherein said incision is collinear with said outer overlap edge.

6. The packing container according to claim 4, wherein said gripping tab overlaps said step.

7. The packing container according to claim 1, wherein said separation strip is bounded by two separation lines, wherein one is formed by said weakening line on said inner overlap area and the other, provided on said overlap area, is defined by said inner overlap edge running beneath it.

8. The packing container according to claim 1, wherein said outer overlap area has a starter portion formed by an incision on said cardboard sleeve.

9. The packing container according to claim 4, wherein said upper edge of said sleeve has rounded corners in the vicinity of said gripper tab and said gripping tab (18) has rounded corners.

* * * * *